United States Patent [19]

Przezdziecki

[11] Patent Number: 4,828,971

[45] Date of Patent: May 9, 1989

[54] THERMALLY PROCESSABLE ELEMENT COMPRISING A BACKING LAYER

[75] Inventor: Wojciech M. Przezdziecki, Pittsford, N.Y.

[73] Assignee: Eastman Kodak Company, Rochester, N.Y.

[21] Appl. No.: 172,667

[22] Filed: Mar. 24, 1988

[51] Int. Cl.[4] ..... G03C 1/82

[52] U.S. Cl. ..... 430/531; 430/271; 430/523; 430/527; 430/350; 430/348; 430/348; 430/961

[58] Field of Search ..... 430/271, 523, 527, 531, 430/950, 961, 348, 350

[56] References Cited

U.S. PATENT DOCUMENTS

| | | | |
|---|---|---|---|
| 3,080,254 | 3/1963 | Grant | 430/616 |
| 3,457,075 | 7/1969 | Morgan et al. | 430/ |
| 3,933,508 | 1/1976 | Ohkubo et al. | 430/523 |
| 4,423,131 | 12/1983 | Limburg et al. | 430/59 |
| 4,584,267 | 4/1986 | Masukawa et al. | 430/619 |
| 4,604,635 | 8/1986 | Wiklof et al. | 346/226 |
| 4,741,992 | 5/1988 | Przezdziecki | 430/523 |

OTHER PUBLICATIONS

Research Disclosure No. 17029, *Research Disclosure*, vol. 170, 1978, Kenneth Mason Publications Ltd., Hampshire, England.

*Primary Examiner*—Jack P. Brammer
*Attorney, Agent, or Firm*—Richard E. Knapp

[57] ABSTRACT

A backing layer comprising a combination of poly(silicic acid) and a water soluble hydroxyl containing polymer or monomer that is compatible with poly(silicic acid) on the side of a support opposite that containing the imaging layer of a thermally processable element enables improved conveyance of the element and reduced static electricity effects during manufacturing and elimination of Newton Rings formation during duplication of the recorded images, without undesired sensitometric effects. A developed visible image is provided in an exposed silver halide photothermographic element comprising such a backing layer by uniformly heating the photothermographic element to moderately elevated temperatures. The described backing layer is also useful on thermographic elements.

8 Claims, No Drawings

THERMALLY PROCESSABLE ELEMENT COMPRISING A BACKING LAYER

This invention relates to a thermally processable imaging element, particularly a photothermographic or thermographic element, comprising a new backing layer that enables improved conveyance, reduced static electricity effects during manufacture and elimination of Newton Rings during manufacture the element without undesired sensitometric effects.

Thermally processable imaging elements, particularly photothermographic and thermographic elements, including films and papers, for producing images by thermal processing are known. These elements include photothermographic elements in which an image is formed by imagewise exposure to light followed by development by uniformly heating the element. These elements also include thermographic elements in which an image is formed by imagewise heating the element. Such elements are described in, for example, *Research Disclosure*, June 1978, Item No. 17029; U.S. Pat. No. 3,457,075; U.S. Pat. No. 3,933,508; and U.S. Pat. No. 3,080,254.

Problems that have been encountered in manufacture of such thermally processable elements, particularly photothermographic silver halide films, include the need to improve the conveyance of the element, that is the movement of the element in the manufacturing steps to enable faster movement. Such movement during manufacture tends to produce static electricity effects that can cause sparks and other undesired sensitometric effects. Another effect that has been encountered is the observation of Newton Rings in the element during subsequent duplication steps. A conventional backing layer or a conventional overcoat layer on such elements has not provided a useful answer to these undesired effects. For example, a cross-linked poly(vinyl alcohol) backing layer does not provide an answer to these effects.

Other materials that have been described as overcoats for thermally processable elements do not satisfy all the requirements for an acceptable backing layer. These materials do not satisfy one or more of the requirements that the backing layer: (a) provide adequate conveyance characteristics during manufacturing steps, (b) provide resistance to deformation of the element during thermal processing, (c) enable satisfactory adhesion of the backing layer to the support of the element without undesired removal during thermal processing, (d) be free from cracking and undesired marking, such as abrasion marking during manufacture, storage and processing of the element, (e) reduce static electricity effects during manufacture and (f) not provide undesired sensitometric effects in the element during manufacture, storage or processing. A continuing need has existed to provide an improved backing layer that satisfies all the described requirements.

It has been found that the described requirements are satisfied by a photothermographic or thermographic imaging element comprising a support bearing on a first side a photothermographic or thermographic imaging layer and, on the side of the support opposite the first side, a backing layer comprising a combination of (a) 0.25% to 60% by weight poly(silicic acid) represented by the formula:

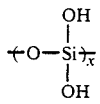

wherein x is an integer within the range of at least 3 to about 600 and (b) a water soluble hydroxyl containing polymer or monomer that is compatible with poly(silicic acid). A preferred backing layer for such an element comprises water soluble poly(vinyl alcohol) or a water soluble cellulose derivative compatible with poly(silicic acid).

The described photothermographic or thermographic element preferably comprises an overcoat layer, that is a layer that is on the imaging layer on the side of the element opposite that containing the backing layer. The overcoat layer is preferably one that comprises a combination of (a) 50% to 90% by weight poly(silicic acid), as described, and (b) a water soluble hydroxyl containing polymer or monomer that is compatible with the poly(silicic acid). Such an overcoat is described in, for example, copending United States patent application Ser. No. 910,033 of W. Przezdziecki, filed Sept. 22, 1986, the disclosure of which is incorporated herein by reference.

The poly(silicic acid) as described is represented by the formula:

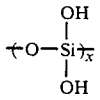

wherein x is an integer sufficient to provide a coatable aqueous solution of poly(silicic acid), such as an integer within the range of at least 3 to about 600.

Poly(silicic acid) is prepared by methods known in the organic synthesis art, such as by hydrolysis of tetraethyl ortho silicate. A typical method of preparing poly(silicic acid) comprises mixing at room temperature (20° C.) distilled water with 1N p-toluenesulfonic acid and absolute alcohol followed by mixing with tetraethyl ortho silicate. A clear solution is obtained within several minutes. The resulting solution of poly(silicic acid) is typically stable at 20° C. for more than 30 days. A 1N aqueous solution of p-toluenesulfonic acid is typically preferred in this preparation although a concentration of 0.1N to 1.0N acid can be used. Stability of the poly(silicic acid) solution is often less than optimum if a lower acid concentration is used in the preparation. Acids which are useful in place of p-toluenesulfonic acid include hydrochloric acid, sulfuric acid, and other mineral acids. A weak organic acid, such as acetic acid, can provide the desired hydrolysis, but the resulting poly(silicic acid) composition provides a gel within several hours. This gel is not conveniently coated without added mixing and preparation steps.

A useful poly(silicic acid) composition as coated does not adversely flow, smear or distort at the processing temperatures of the element, typically within the range of 100° C. to 200° C.

The optimum concentration of poly(silicic acid) in the backing layer and the overcoat will vary depending upon the components in the backing layer, the particular support, the particular photothermographic or thermographic element and processing conditions. Concentrations of poly(silicic acid) below 0.25% and above 60% by weight when poly(vinyl alcohol) is present in the backing layer do not provide the desired results. Preferably when poly(vinyl alcohol) is present in the backing layer the concentration of poly(silicic acid) is within the range of 10% to 30% by weight of the backing layer, and the poly(vinyl alcohol) is within the range of 70% to 90% by weight of the backing layer.

Useful backing layer compositions comprising the poly(silicic acid) are typically transparent and colorless. The backing layer and overcoat comprising poly(silicic acid) do not significantly adversely affect the imaging properties, such as the sensitometric properties in the case of a photothermographic element, such as minimum density, maximum density or photographic speed.

Other components, particularly other polymers, can be useful with the poly(silicic acid) in the backing layer. Other components that can be useful in combination with poly(silicic acid) in the backing layer include, for example, other polymers, such as water soluble hydroxyl containing polymers that are compatible with poly(silicic acid), for example, acrylamide polymers, water soluble cellulose derivatives, such as water soluble cellulose acetate, and hydroxy ethyl cellulose acetate and the like. It is important that the water soluble polymer be compatible with poly(silicic acid).

Imaging elements, particularly photothermographic and thermographic elements as described can comprise, if desired, multiple polymer containing layers, particularly multiple overcoat layers and backing layers. For example, an imaging element as described can comprise a first overcoat layer comprising a polymer other than poly(silicic acid), such as a water soluble cellulose derivative, for example, water soluble cellulose acetate, and a second overcoat layer comprising poly(silicic acid) and another polymer.

The backing layer as described is useful on any thermally processable element, particularly any photothermographic element or thermographic element, that is compatible with poly(silicic acid). The thermally processable element can be a black and white imaging element or a dye-forming thermally processable imaging element. The overcoat is particularly useful on a silver halide photothermographic element designed for dry physical development. Useful silver halide elements on which the backing layer is useful are described in, for example, U.S. Pat. Nos. 3,457,075; 4,459,350; 4,264,725 and *Research Disclosure*, June 1978, Item No. 17029. The backing layer is particularly useful on, for example, a photothermographic element comprising a support bearing, in reactive association, in a binder, (a) photographic silver halide, prepared ex situ and/or in situ, (b) an image forming combination comprising (i) an organic silver salt oxidizing agent, preferably a silver salt of a large chain fatty acid, such as silver behenate, with (ii) a reducing agent for the organic silver salt oxidizing agent, preferably a phenolic reducing agent, and (c) an optional toning agent.

A preferred embodiment of the invention comprises a photothermographic element comprising a support, typically a poly(ethyleneterephthalate) film support, having an adhesive subbing layer bearing, in reactive association, in a binder, particularly a poly(vinyl butyral) binder, (a) photographic silver halide, prepared in situ and/or ex situ, (b) an image-forming combination comprising (i) silver behenate, with (ii) a phenolic reducing agent for the silver behenate, (c) a toning agent, such as succinimide, and (d) an image stabilizer, such as 2-bromo-2-(4-methylphenylsulfonyl) acetamide, and having a backing layer according to the invention, preferably a backing layer comprising a combination of (a) poly(silicic acid) and (b) water soluble poly(vinyl alcohol) which is 80% to 99% hydrolyzed.

The backing layer is preferably applied to the thermally processable element at the time of manufacture of the element; however, the backing layer can optionally be applied to the element at any stage after preparation of the element if desired.

The optimum backing layer thickness depends upon various factors, such as the particular element, processing conditions, thermal processing means, desired image and the particular backing layer. A particularly useful backing layer thickness is within the range of 0.1 to 2.0 microns, preferably 0.5 to 1.0 micron.

The backing layer as described can contain addenda that are known to be useful in backing layers, such as matting agents, dyes, surfactants, solvents and other components that do not adversely affect the sensitometric properties of the element. For example, the backing layer can contain a matting agent that comprises polymeric beads, such as poly(methyl methacrylate) beads, that are compatible with poly(silicic acid). The most effective concentration of such addenda will vary depending upon the particular imaging element, the particular components of the backing layer, processing conditions, intended purpose of the addenda and the like. A useful concentration of matting agent, such as poly(methyl methacrylate) beads is typically within the range of 1% to 5% by weight of the backing layer.

The support of the element as described typically has a subbing layer, that is a layer between the backing layer and the support to improve adhesion of the backing layer to the support. The side of the support opposite that containing the backing layer typcally also has a subbing layer to improve adhesion. The subbing layer typically comprises a polymer known to be useful for film supports, such as described in U.S. Pat. No. 3,271,345. An example of such a subbing layer is a latex terpolymer comprising poly(2-propenenitrile-Co-1, 1-dichloroethene-Co-2-propenoic acid).

The photothermographic elements comprise a photosensitive component which consists essentially of photographic silver halide. In the photothermographic materials it is believed that the latent image silver from the silver halide acts as a catalyst for the described oxidation-reduction image-forming combination upon processing. A preferred concentration of photographic silver halide is within the range of about 0.01 to about 10 moles of photographic silver halide per mole of organic silver salt oxidizing agent, such as per mole of silver behenate, in the photothermographic material. Other photosensitive silver salts are useful in combination with the photographic silver halide if desired. Preferred photographic silver halides are silver chloride, silver bromide, silver bromoiodide, silver chlorobromoiodide and mixtures of these silver halides. Very fine grain photographic silver halide is especially useful. The photographic silver halide can be prepared by any of the procedures known in the photographic art. Such procedures for forming photographic silver halide and forms of photographic silver halide are described in, for example, *Research Disclosure*, June 1978, Item No. 17029 and *Research Disclosure*, December 1978, Item No. 17643. Tabular grain photosensitive silver halide is also useful, as described in, for example, U.S. Pat. No. 4,435,499. The photographic silver halide can be unwashed or washed, chemically sensitized, protected against the production of fog and stabilized against loss of sensitivity during keeping as described in the above Research Disclosure publications. The silver halide can be prepared in situ as described in, for example, U.S. Pat. No. 3,457,075.

The photothermographic elements typically comprise an oxidation-reduction image-forming combination which contains an organic silver salt oxidizing agent, preferably a silver salt of a long-chain fatty acid. Such organic silver salt oxidizing agents are resistant to darkening upon illumination. Preferred organic silver salt oxidizing agents are silver salts of long-chain fatty acids containing 10 to 30 carbon atoms. Examples of useful organic silver salt oxidizing agents are silver behenate, silver stearate, silver oleate, silver laurate, silver hydroxystearate, silver caprate, silver myristate and silver palmitate. Combinations of organic silver salt oxidizing agents are also useful. Examples of useful silver salt oxidizing agents which are not silver salts of long-chain fatty acids include, for example, silver benzoate and silver benzotriazole.

The optimum concentration of organic silver salt oxidizing agent in a photothermographic material will vary depending upon the desired image, particular organic silver salt oxidizing agent, particular reducing agent and particular photothermographic element. A preferred concentration of organic silver salt reducing agent is preferably within the range of about 0.1 to about 100 moles of organic silver salt reducing agent per mole of Ag. When combinations of organic silver salt oxidizing agents are present, the total concentration of organic silver salt oxidizing agents is preferably within the described concentration range.

A variety of reducing agents are useful in the photothermographic materials. Examples of useful reducing agents include substituted phenols and naphthols such as bis-$\beta$-naphthols; polydroxy-benzenes, such as hydroquinones, including hydroquinone, alkyl-substituted hydroquinones, such as tertiarybutylhydroquinone, methylhydroquinone, 2,5-dimethylhydroquinone and 2,6-dimethylhydroquinone; catechols and pyrogallols; aminophenol reducing agents, such as 2,4-diaminophenols and methylaminophenols; ascorbic acid reducing agents, such as ascorbic acid, ascorbic acid ketals and other ascorbic acid derivatives; hydroxylamine reducing agents; 3-pyrazolidone reducing agents, such as 1-phenyl-3-pyrazolidone and 4-methyl-4-hydroxymethyl-1-phenyl-3-pyrazolidone; sulfonamidophenos and other organic reducing agents described in U.S. Pat. No. 3,933,508 and *Research Disclosure*, June 1978, Item No. 17029, the description of which is incorporated herein by reference. Combinations of organic reducing agents are also useful.

Preferred organic reducing agents in photothermographic materials are sulfonamidophenol reducing agents, such as described in U.S. Pat. No. 3,801,321. Examples of useful sulfonamidophenol reducing agent include 2,6-dichloro-4-benzene-sulfonamidophenol; benzenesulfonamidophenol; 2,6-dibromo-4-benzenesulfonamidophenol and mixtures thereof.

An optimum concentration of reducing agent in a photothermographic material varies depending upon such factors as the particular photothermographic element, desired image, processing conditions, the particular organic silver salt oxidizing agent and the particular stabilizer precursor. A preferred concentration of reducing agent is within the range of about 0.2 mole to about 2.0 moles of reducing agent per mole of silver in the photothermographic material. When combinations of reducing agents are present, the total concentration of reducing agent is preferably within the described concentration range.

The photothermographic materials preferably comprise a toning agent, also known as an activator-toning agent or a toner-accelerator. Combinations of toning agents are useful in photothermographic materials. An optimum toning agent or toning agent combination depends upon such factors as the particular photothermographic material, particular components in the photothermographic material, desired image and processing conditions. Examples of useful toning agents and toning agent combinations are described in, for example, *Research Disclosure*, June 1978, Item No. 17029 and U.S. Pat. No. 4,123,282. Examples of useful toning agents include, for instance, phthalimide, N-hydroxyphthalimide, N-potassium phthalimide, succinimide, N-hydroxy-1,8-naphthalimide, phthalazine, 1-(2H)-phthalazinone and 2-acetylphthalazinone.

Stabilizers which are useful in photothermographic materials include photolytically active stabilizers and stabilizer precursors as described in, for example, U.S. Pat. No. 4,459,350, and include, for instance, azole thioethers and blocked azolinethione stabilizer precursors and carbamoyl stabilizer precursors such as described in U.S. Pat. No. 3,877,940.

Photothermographic materials as described preferably contain various colloids and polymers alone or in combination as vehicles, binding agents and in various layers. Useful materials are hydrophobic or hydrophilic. They are transparent or translucent and include both naturally occurring substances such as proteins, for example gelatin, gelatin derivatives, cellulose derivatives, polysaccharides, such as dextran, gum arabic and the like; and synthetic polymeric substances, such as water-soluble polyvinyl compounds like poly(vinylpyrrolidone) and acrylamide polymers. Other synthetic polymeric compounds which are useful include dispersed vinyl compounds such as in latex form and particularly those which increase dimensional stability of photographic materials. Effective polymers include water insoluble polymers of alkylacrylates and methacrylates, acrylic acid, sulfoalkylacrylates and those which have cross-linking sites which facilitate hardening or curing. Preferred high molecular weight materials and resins include poly(vinylbutyral), cellulose acetate butyrate, poly(methylmethacrylate), poly(vinylpyrrolidone), ethyl cellulose, polystyrene, poly(vinylchloride), chlorinated rubbers, polyisobutylene, butadiene-styrene copolymers, vinyl chloride-vinylacetate copolymers, copolymers of vinylacetate and vinylchloride, poly(vinyl alcohol) and polycarbonates.

Photothermographic materials can contain development modifiers that function as speed increasing compounds, sensitizing dyes, hardeners, antistatic layers, plasticizer and lubricants, coating aids, brighteners, absorbing and filtered dyes, such as described in *Research Disclosure*, June 1978, Item No. 17029 and *Research Disclosure*, December 1978, Item No. 17643.

The thermally processable elements according to the invention comprise a variety of supports. Examples of useful supports include poly(vinylacetal) film, polystyrene film, poly(ethyleneterephthalate) film, polycarbonate film and related films or resinous materials, as well as glass, paper, metal and other supports which can withstand the thermal processing temperatures.

The layers, including the backing layer, of thermally processable elements as described are coated on a support by coating procedures known in the photographic art, including dip coating, air knife coating, curtain coating or extrusion coating using hoppers. If desired, two or more layers are coated simultaneously.

Spectral sensitizing dyes are useful in the described photothermographic materials to confer additional sensitivity to the elements and compositions. Useful sensitizing dyes are described in, for example, *Research Disclosure*, June 1978, Item No. 17029 and *Research Disclosure*, December 1978, Item No. 17643.

A photothermographic material preferably comprises a thermal stabilizer to help stabilize the photothermographic material prior to imagewise exposure and thermal processing. Such a thermal stabilizer aids improvement of stability of the photothermographic material during storage. Preferred thermal stabilizers are:

(a) 2-bromo-2-arylsulfonylacetamides, such as 2-bromo-2-p- tolysulfonylacetamide, (b) 2(tribromomethyl sulfonyl) benzothiazole and (c) 6-substituted-2,4-bis(tribromomethyl)-s-triazines, such as 6-methyl or 6-phenyl-2,4-bis(tribromomethyl)-s-triazine.

The thermally processable elements as described are imagewise exposed by means of various forms of energy in the case of silver halide photothermographic elements. Such forms of energy include those to which the photosensitive silver halide is sensitive and encompass the ultraviolet, visible and infrared regions of the electromagnetic spectrum as well as electron beam and beta radiation, gamma ray, x-ray, alpha particle, neutron radiation and other forms of corpuscular wave-like radiant energy in either non-coherent (random phase) forms or coherent (in phase) forms as produced by lasers. Exposures are monochromatic, orthochromatic, or panchromatic depending upon the spectral sensitization of the photographic silver halide. Imagewise exposure is preferably for a sufficient time and intensity to produce a developable latent image in the photothermographic material. After imagewise exposure of the photothermographic material, the resulting latent image is developed merely by overall heating the element to moderately elevated temperatures. This overall heating merely involves heating the photothermographic element to a temperature within the range of about 90° C., to about 150° C., until a developed image is produced, such as within about 0.5 to about 60 seconds. By increasing or decreasing the length of time of heating, a higher or lower temperature within the described range is useful depending upon the desired image, the particular components of the photothermographic material and heating means. A preferred processing temperature is within the range of about 100° C. to about 130° C.

In the case of thermographic elements, the thermal energy source and means for imaging purposes can be any imagewise thermal exposure source and means that are known in the thermographic imaging art. The imagewise heating means can be, for example, an infrared heating means, laser, microwave heating means or the like.

Heating means known in the photothermographic and thermographic art are useful for providing the desired processing temperature range. The heating means is, for example, a simple hot plate, iron, roller, heated drum, microwave heating means, heated air or the like.

Thermal processing is preferably carried out under ambient conditions of pressure and humidity. Conditions outside normal atmospheric pressure and humidity are useful if desired.

The components of the thermally processable element as described can be in any location in the element which provides the desired image. If desired, one or more components of the photothermographic element are in one or more layers of the element. For example, in some cases, it is desirable to include certain percentages of the reducing agent, toner, stabilizer precursor and/or other addenda in the overcoat layer over the photothermographic layer of the element. This, in some cases, reduces migration of certain addenda in the layers of the photothermographic element.

It is necessary that the components of the imaging combination be "in association" with each other in order to produce the desired image. The term "in association" herein means that in a photothermographic element the photosensitive silver halide and the image-forming combination are in a location with respect to each other which enables the desired processing and produces a useful image.

Thermographic elements on which the described backing layer is useful include any that are compatible with poly(silicic acid). Such thermographic elements include those described in, for example, U.S. Pat. Nos. 2,663,657; 2,910,377; 3,028,254; 3,031,329 and 3,080,254, the disclosure of which are incorporated herein by reference. An example of a useful thermographic element comprises a support bearing a thermographic layer comprising materials designed for electrically activated recording and thermography known in the imaging arts, and a backing layer comprising poly(silicic acid) as described.

The term water soluble herein means at least 2 grams of the compound or compositions dissolves in one liter of water within 2 hours at 90° C.

The following examples further illustrate the invention.

EXAMPLE 1

Two film materials were prepared according to the following diagram:

| A (Control) | B |
|---|---|
| OVERCOAT LAYER | OVERCOAT LAYER |
| PHOTOTHERMOGRAPHIC LAYER | PHOTOTHERMOGRAPHIC LAYER |
| SUBBING LAYER | SUBBING LAYER |
| FILM SUPPORT* | FILM SUPPORT* |
| | SUBBING LAYER |
| | BACKING LAYER |

*4 mil blue poly(ethylene terephthalate film support

OVERCOAT

Common to A and B—having the following composition:

| | |
|---|---|
| PSA (ELVANOL 52/22)** | 100 mg/ft$^2$ |
| Poly(silicic acid)[$Si(OH)_4$] | 125 mg/ft$^2$ |
| Methylmethacrylate Beads | 5 mg/ft$^2$ |

**ELVANOL 52/22 is a trademark of E.I. duPont deNemours Co., U.S.A.

PHOTOTHERMOGRAPHIC LAYER

Common To A and B—The photothermographic layer was prepared and coated as follows:

| | mg/ft$^2$ |
|---|---|
| Silver Behenate (Ag) | 80.0 |
| $HgBr_2$ (Hg) | 0.1 |
| AgBr (Ag) | 40.0 |
| Na I | 3.5 |
| Succinimide (toner/development modified) | 42.0 |
| Surfactant (SF-96 which is a polysiloxane fluid and is available from and a trademark of General Electric Co., U.S.A. | 1.5 |
| Monobromo stabilizer: 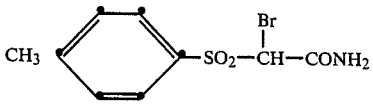 | 6.0 |
| 2,4-bis(trichloromethyl)-6-(1-naptho)-s-triazine (stabilizer as described in U.S. Pat. No. 4,459,350) | 6.0 |
| Poly(vinyl butyral) binder (BUTVAR B-76, a trademark of Monsanto Co., U.S.A. | 400.0 |
| Sensitizing dye | 0.5 |
| Benzenesulfonamidophenol (developing agent) | 100.0 |
| Methyl isobutyl ketone (MIBK solvent) | 30.0 |

BACKING LAYER

For B only—The composition described below was coated on the support prior to coating of the photothermographic and overcoat layers. The composition was coated at the wet laydown indicated, dried and heated to 93° C. for 2 minutes. The backing layer was prepared as follows:

1. Poly(silicic acid) was prepared as follows; the following components were mixed at room temperature (20° C.) in the order given:

| | |
|---|---|
| Distilled Water | 172.8 g |
| 1N p-toluene sulfonic acid | 7.2 g |
| Ethanol | 200.0 g |
| Tetraethylortho silicate (TEOS) | 208.0 g |

This formed poly(silicic acid).

2. A coating solution for the backing layer was prepared as follows; the following components were mixed in the order given:

| | |
|---|---|
| 8% W/W ELVAOL 52/22 in water | 33.4 g |
| Distilled Water | 343.8 g |
| Poly(silicic acid) | 20.4 g |
| 10% Surfactant 10G (Trade mark of Olin Corp, U.S.A.) | 1.0 g |
| 40% Methylmethacrylate Beads slurry in water | 1.4 g |

3. Coat at 3.75 cc/ft$^2$ to provide the following coverage:

| | |
|---|---|
| (a) Poly(vinyl alcohol) | 34 mg/ft$^2$ |
| (b) Poly(silicic acid) (b/a = 1.25) | 42 mg/ft$^2$ |
| Matte (methylmethacrylate beads) | 5 mg/ft$^2$ |

TESTING:

1. Newton Rings—When the original photothermographic film A (control) in the form of a fiche is held on a glass plate by vacuum during duplication, Newton Rings are often observed. These are easily reproduced on vesicular (thermal) film, which detracts from the quality of reproduction.

2. Performance in Duplicating Equipment—KADAK EKTAFICHE Duplicator, KODAK KOMSTAR Finisher (KODAK, EKTAFICHE, and KOMSTAR are trademarks of Eastman Kodak Company, U.S.A).

The photothermographic film after exposure and processing, in fiche form, to be duplicated was held during exposure on a glass platen by vacuum. At the end of exposure the vacuum release is faster when the back of the fiche contained some matte particles, thus facilitating more reliable transport in the duplicator. This is especially noticeable in the absence of curl, as when the overcoat comprises poly(silicic acid).

3. Ra Measurement—Ra herein means Roughness Average ($\mu$ inches), which is the arithmetic average of all departures of the roughness profile from the mean line. The Ra was measured for the surface of the side of the photothermographic film opposite that containing the overcoat layer.

TABLE I

TEST SUMMARY

| | A (Control) | B |
|---|---|---|
| Backing | No | Yes |
| Newton Rins | Yes | No |
| Transport in Duplicators | Occasional Failures | No Failures |
| Ra $\mu$ inches (back of the support) | <1.0 | 3–8 |

The data in Table I indicates the unexpected improved transport of the photothermographic film B and also the lack of Newton Ring formation using film B.

EXAMPLE 2.

Experimental film was prepared as in Example 1B, except that the backing had the following composition:

| | |
|---|---|
| (a) Poly(vInyl alcohol) | 20 mg/ft$^2$ |
| (b) Poly(silicic acid) (b/a = 0.75) | 15 mg/ft$^2$ |
| Matte | 2.5 mg/ft$^2$ |

Results were similar to those observed in Example 1. The matte consisted of methylmethacrylate beads.

The invention has been described in detail with particular reference to preferred embodiments thereof, but it will be understood that variations and modifications can be effected within the spirit and scope of the invention.

What is claimed is:

1. A photothermographic or thermographic imaging element comprising a support bearing on a first side a photothermographic or thermographic imaging layer and, on the side of the support opposite the first side, a backing layer comprising the combination of (a) 0.25% to 60% by weight poly(silicic acid) represented by the formula:

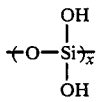

wherein x is an integer within the range of at least 3 to about 600 and (b) a water soluble hydroxyl containing polymer or monomer that is compatible with poly(silicic acid).

2. A photothermographic or thermographic imaging element as in claim 1 wherein the water soluble hydroxyl containing polymer or monomer comprises 70 to 90% by weight of poly(vinyl alcohol).

3. A photothermographic or thermographic imaging element as in claim 1 wherein the water soluble hydroxyl containing polymer or monomer comprises 70 to 90% by weight water soluble poly(vinyl alcohol) that is 80% to 90% hydrolyzed.

4. A photothermographic or thermographic imaging element as in claim 1 comprising an overcoat layer on the photothermographic or thermographic imaging layer.

5. A photothermographic or thermographic imaging element as in claim 1 comprising an overcoat layer comprising a combination of (a) 50% to 90% by weight poly(silicic acid) represented by the formula:

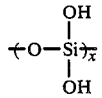

wherein x is an integer within the range of at least 3 to about 600 and (b) a water soluble hydroxyl containing polymer or monomer that is compatible with poly(silicic acid).

6. A photothermographic or thermographic imaging element as in claim 1 comprising an adhesive polymeric subbing layer between the support and the backing layer.

7. A photothermographic or thermographic imaging element as in claim 1 comprising, in the backing layer, a matting agent.

8. A photothermographic or thermographic imaging element as in claim 1 comprising, in the backing layer, a matting agent comprising poly(methyl methacrylate) beads.

* * * * *